US009940821B2

(12) United States Patent
Nold

(10) Patent No.: US 9,940,821 B2
(45) Date of Patent: *Apr. 10, 2018

(54) SYSTEMS AND METHODS OF PRIVACY WITHIN A SECURITY SYSTEM

(71) Applicant: Google Inc., Mountain View, CA (US)

(72) Inventor: John Jordan Nold, Boulder, CO (US)

(73) Assignee: Google LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/289,233

(22) Filed: Oct. 10, 2016

(65) Prior Publication Data

US 2017/0024996 A1 Jan. 26, 2017

Related U.S. Application Data

(63) Continuation of application No. 14/661,126, filed on Mar. 18, 2015, now Pat. No. 9,489,822.

(51) Int. Cl.

| | |
|---|---|
| ***E05B 45/06*** | (2006.01) |
| ***G08B 25/00*** | (2006.01) |
| ***G07C 9/00*** | (2006.01) |
| ***G08B 13/22*** | (2006.01) |
| ***G08B 17/06*** | (2006.01) |
| ***G08B 13/08*** | (2006.01) |

(52) U.S. Cl.

CPC ..... *G08B 25/008* (2013.01); *G07C 9/00174* (2013.01); *G08B 13/08* (2013.01); *G08B 13/22* (2013.01); *G08B 17/06* (2013.01)

(58) Field of Classification Search

CPC ..... E05B 13/004; E05B 2047/002; E05B 2047/0094; E05B 47/0012; E05B 47/0673; E05B 63/0065; Y10T 292/0983; Y10T 70/5226; Y10T 70/5394; Y10T 70/5398; Y10T 70/5465; Y10T 70/5473; Y10T 70/577; Y10T 70/7102; Y10T 70/7107; Y10T 70/713; G08B 25/008

USPC ..... 340/501, 542, 825.34; 70/91, 106, 109, 70/107, 141, 275, 278, 285; 318/264, 318/265, 266, 286

See application file for complete search history.

(56) References Cited

U.S. PATENT DOCUMENTS

| | | | |
|---|---|---|---|
| 5,311,168 | A | 5/1994 | Pease, Jr. et al. |
| 5,433,495 | A | 7/1995 | Uffner |

(Continued)

FOREIGN PATENT DOCUMENTS

| | | | |
|---|---|---|---|
| WO | WO-2012119185 | A1 | 9/2012 |
| WO | WO-2014081223 | A1 | 5/2014 |

OTHER PUBLICATIONS

International Search Report and Written Opinion issued in PCT/US2016/022919 dated Jun. 23, 2016.

*Primary Examiner* — Ojiako O Nwugo

(74) *Attorney, Agent, or Firm* — Morris & Kamlay LLP

(57) ABSTRACT

Systems and methods disclosed herein provide setting a mode for a door lock of a door in a building with an electronic device communicatively coupled to the door lock via a communications interface of the door lock, when the mode of the door lock is set in a privacy mode, correspondingly placing a security system device communicatively coupled to the door lock into a privacy mode via the communications interface, and updating an operation state of the security system in the building according to the setting of the privacy mode for the door lock and the device.

36 Claims, 7 Drawing Sheets

(56) References Cited

U.S. PATENT DOCUMENTS 5,608,298 A * 3/1997 Frolov ..... E05B 47/0012 318/265
5,923,264 A 7/1999 Lavelle et al.
6,876,293 B2 4/2005 Frolov et al.
7,741,969 B2 6/2010 Linford
7,870,770 B2 1/2011 Blanch
8,674,832 B1 3/2014 Thomas
2001/0029585 A1* 10/2001 Simon ..... G08B 25/008 726/4
2002/0101083 A1* 8/2002 Toledano ..... E05B 63/20 292/332
2003/0132829 A1* 7/2003 Frolov ..... E05B 47/00 340/5.7
2006/0064384 A1* 3/2006 Mehrotra ..... G01S 3/7864 705/57
2008/0061927 A1* 3/2008 Manton ..... E05B 17/002 340/5.53
2008/0236213 A1* 10/2008 Blanch ..... E05B 13/004 70/107
2008/0238669 A1* 10/2008 Linford ..... E05B 45/06 340/542
2012/0122418 A1* 5/2012 Hicks, III ..... G08B 25/001 455/404.1
2013/0113434 A1* 5/2013 Haga ..... H02J 3/32 320/134
2014/0051355 A1* 2/2014 Ahearn ..... G07C 9/00174 455/41.1
2014/0135993 A1* 5/2014 Kang ..... G05B 15/02 700/275
2014/0265359 A1 9/2014 Cheng et al.
2015/0027178 A1 1/2015 Scalisi
2015/0049191 A1 2/2015 Scalisi et al.
2016/0149716 A1* 5/2016 Raj ..... H04L 12/282 700/275
2016/0189531 A1* 6/2016 Modi ..... G08B 29/185 340/506

* cited by examiner

SYSTEMS AND METHODS OF PRIVACY WITHIN A SECURITY SYSTEM

BACKGROUND

Presently-available door locks can have a privacy mode that prevents people from entering a room or building via a door with the door lock. However, this privacy mode only applies to the door lock itself, and does not apply to the building, or any of the other devices of the security system in a building or home. That is, in typical security systems, if it is desired to have full home privacy, a user would have to either set or turn off each individual device associated with the security system so as to have true privacy within the user's home. For example, in typical systems, a user may have to set the door lock to a privacy mode, turn off a camera of the security system so that it does not record video, turn off any notifications, and the like.

BRIEF SUMMARY

According to an embodiment of the disclosed subject matter, a method may provide setting a mode for a door lock of a door in a building with an electronic device communicatively coupled to the door lock via a communications interface of the door lock, when the mode of the door lock is set in a privacy mode, correspondingly placing a security system device communicatively coupled to the door lock into a privacy mode via the communications interface, and updating an operation state of the security system in the building according to the setting of the privacy mode for the door lock and the device.

According to an embodiment of the disclosed subject matter, a system may include a door lock of a door in a building, wherein the door lock has a plurality of modes of operation and includes a communications interface, a device of a security system of the building communicatively coupled to the door lock via the communications interface, and an electronic device communicatively coupled to the door lock via the communications interface to set the mode of the door lock in a privacy mode and to correspondingly set a privacy mode as a mode for the device, wherein the electronic device updates an operation state of the security system according to the setting of the privacy mode for the door lock and the device.

According to an embodiment of the disclosed subject matter, means for setting privacy within a security system are provided, including setting a mode for a door lock of a door in a building with an electronic device communicatively coupled to the door lock via a communications interface of the door lock, when the mode of the door lock is set in a privacy mode, correspondingly placing a security system device communicatively coupled to the door lock into a privacy mode, and updating an operation state of the security system in the building according to the setting of the privacy mode for the door lock and the device Additional features, advantages, and embodiments of the disclosed subject matter may be set forth or apparent from consideration of the following detailed description, drawings, and claims. Moreover, it is to be understood that both the foregoing summary and the following detailed description are illustrative and are intended to provide further explanation without limiting the scope of the claims.

BRIEF DESCRIPTION OF THE DRAWINGS

The accompanying drawings, which are included to provide a further understanding of the disclosed subject matter, are incorporated in and constitute a part of this specification. The drawings also illustrate embodiments of the disclosed subject matter and together with the detailed description serve to explain the principles of embodiments of the disclosed subject matter. No attempt is made to show structural details in more detail than may be necessary for a fundamental understanding of the disclosed subject matter and various ways in which it may be practiced.

DETAILED DESCRIPTION

Figure 1:
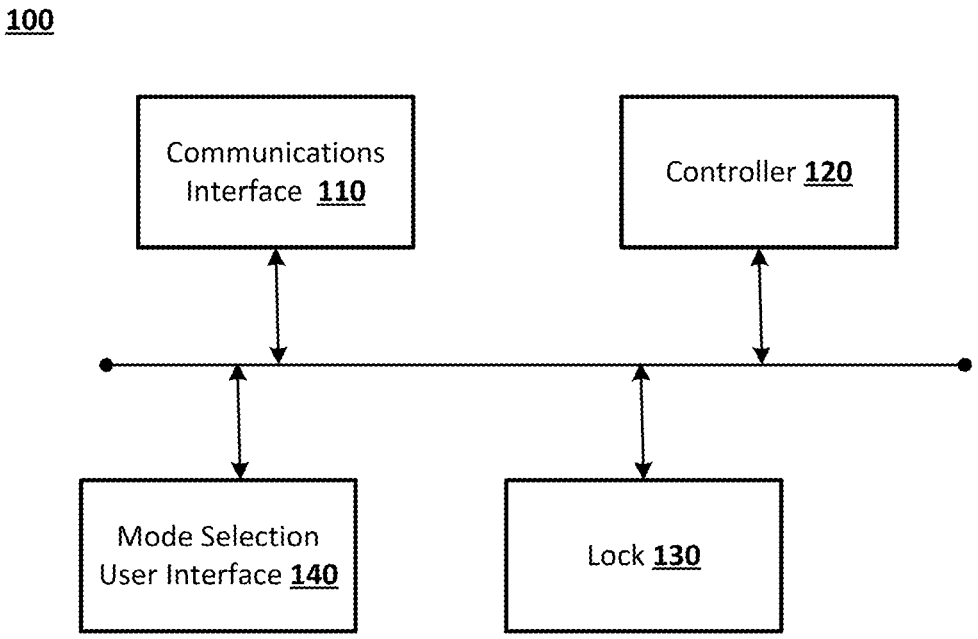
FIG. 1 shows a door lock that may set a privacy mode according to an embodiment of the disclosed subject matter.

In an implementation of the disclosed subject matter, a door lock may have a privacy mode that, when enabled, may prevent people from entering the room and/or building associated with the door having the door lock. This privacy mode may apply to the door lock, and to one or more devices (e.g., devices of a home or building security system) associated with the door lock and/or a room associated with the door of the door lock. The associated devices, which may be communicatively coupled to the door lock directly and/or via a network of a home or building security system (e.g., a mesh network of a security system) may set a privacy mode that may refrain from collecting data and/or outputting data when the privacy mode of the door lock is set, or may actuate window treatments to cover windows in a room, and/or adjust the lighting in the room associated with the door lock. The devices may be sensors (e.g., motion sensors, light sensors, heat sensors, etc.), video cameras, window treatments, and the like. By operating the associated devices in a privacy mode when the door lock is set to the privacy mode, the user and/or building occupant may not have to individually adjust the modes of operation of one or more devices to attain the desired privacy.

In some implementations, the door lock may include other device types, and/or collections of devices. For example, the setting of the mode may be for a virtual door lock (e.g., where there is no physical lock, but there is an indicator and/or device to identify whether a room, office, and/or conference room is occupied and privacy is desired). Alternatively, or in addition, the setting of the mode may be to indicate a room status and/or floor status (e.g., that the room and/or floor of the building is occupied, and privacy is desired). Alternatively, or in addition, the setting of the mode may be for an area of a floor of the building (e.g., that the designated area of the floor building is occupied, and privacy is desired). Alternatively, or in addition, the setting mode may be for a doorbell that is associated with an exterior door for a home or building, and/or one or more sensors of a room and/or area of a home or building.

The privacy mode of the door lock and/or one or more devices associated with the door lock, and/or other device types as discussed above may be enabled or disabled via a user interface on the door lock, and/or via an electronic device that is communicatively coupled to the door lock via a communications interface. The electronic device may be a smartphone, smart watch, wearable computing device, tablet computer, or the like. The electronic device may have a user interface to receive a selection to enable or disable the privacy mode, to set attributes of the privacy mode, and to set a privacy mode for one or more rooms of the home or building.

In an implementation of the disclosed subject matter, when the privacy mode of the door lock of a door is enabled, video cameras within the room associated with the door may be at least partially disabled, such as by being placed into a "privacy," "sleep" mode (e.g., where the cameras may receive power, but may not be actively capturing and/or transmitting captured image data) or "off" mode (e.g., where the camera does not receive power and/or does not capture and/or transmit image data), and/or may refrain from outputting captured imaged to the security system. The video cameras for one or more other rooms of the building may be at least partially disabled (e.g., set so as to not capture data and/or transmit data to the security system controller) when the privacy mode is enabled. When the privacy mode is extended, for example, to one or more video cameras, the collection and/or transmission of images may be at least partially disabled, such that when an electronic device (e.g., a smartphone, a smart watch, a wearable computing device, a tablet computer, or the like) executes an application of the security system to view the video from the video cameras, the application may be prohibited from viewing the captured video. For example, if the security system is in a building that includes a public business, and the video feed from the video cameras is typically a public feed, the enabling of the privacy mode may at least partially disable the public video feed. In another example, the enabling of the privacy mode may at least partially disable one or more users of the security application on an electronic device (e.g., a smartphone, a smart watch, a wearable computing device, a tablet computer, or the like) from using the application and/or from controlling the one or more devices of the security system that may be operating in a privacy mode for the duration in which the one or more devices are operating in the privacy mode.

In an implementation of the disclosed subject matter, one or more sensors of a security system for a home or building may be turned off, may refrain from collecting data, and/or transmitting collected data to a security system controller when a privacy mode is enabled. For example, the sensors may be turned off, may refrain from collecting data, and/or transmitting collected data to a security system controller for activity and/or events occurring within a building or home. That is, the one or more sensors of the security system may collect data for activities and/or events occurring outside the home or building (e.g., an exterior event). In another example, one or more rooms of the house or building may be selected (e.g., using an application on an electronic device) such that one or more devices within the selected rooms may have the privacy mode enabled.

For example, one or more devices of the security system in a bedroom may be selected to operate in a privacy mode. That is, when a door lock associated with a door to a bedroom is set for a privacy mode, the devices of the security system in the bedroom may also operate in a privacy mode. One or more video camera and/or motion sensors in the bedroom may be turned off, or may refrain from capturing images and/or data, and/or may refrain from transmitting captured images and/or data to a controller of a security system as previously described. Window treatments for windows in the bedroom may operate in a privacy mode in the bedroom, so as to be lowered to cover the windows. The amount of light output by the lights in the bedroom may be changed when the lights operate in the privacy mode. For example, the lights operating in the privacy mode may be controlled so as to be dimmed to a predetermined light level or turned off. Alternatively, the light levels may be adjusted (e.g., to increase or decrease light output) to a preset light output level when the lights are set to operate in the privacy mode.

In another example, when the privacy mode of the door lock is enabled, a doorbell of the home or building may enter a privacy mode such that it does not activate an audible noise when activated. An intercom associated with the door (e.g., a front door of a home) may be at least partially disabled and/or inactivated when the intercom operates in a privacy mode. A garage door of a home may be operated so as to close when the privacy mode is enabled.

When the privacy mode for a device type other than a door lock is enabled, a privacy mode may be set as previously described so as to control one or more sensors in a room, a floor of a building, and/or an area of a building. For example, a device for an office and/or conference room that does not have a door lock may be set to a privacy mode, which may at least partially disable one or more sensors in the room and/or conference room. In another example, an area of a floor of a building may be defined (e.g., by the electronic device described above), and one or more sensors for the defined area may be set to the privacy mode. In yet another example, a privacy mode for a room in a building may be enabled (e.g., automatically enabled) as described above when one or more sensors determine all of the doors and/or windows in a room and/or designated area are closed and/or locked. In a further example, a privacy mode for a room in a building may be enabled as described above when the window treatments for the windows are positioned as to cover the windows by a predetermined amount (e.g., completely cover the window, cover 75% of the surface of the window, or the like).

In some implementations, the electronic device may limit and/or turn off the display of notifications related to the operation of the security system. The electronic device may at least partially disable the receipt of phone calls, email, text messages, and the like when the door lock and/or electronic device is operating in the privacy mode. For example, the electronic device may disable the receipt of phone calls, but allow the receipt of text messages and emails in the privacy mode. In another example, the electronic device may disable the receipt of phone calls, emails, and text messages. In some implementations, the electronic device may provide notifications of phone calls, emails, text messages, and the like when the communication is from any preselected contact, and/or is from a person on an emergency contact list.

When the door lock is operating in the privacy mode, the electronic device may continue to receive notifications regarding smoke, fire, unlawful entry, break-in event, and/or other safety-related events detected by the security system.

In some implementations of the disclosed subject matter, the security system may require that a person (e.g., having the electronic device such as a smartphone, smart watch, wearable computing device, tablet computer, or the like) be present in a room having the door lock before the privacy mode can be enabled for the door lock and associated devices. One or more sensors in the room and/or building may determine whether the person is in the room where the privacy mode is being set so as to be enabled.

FIG. 1 shows a door lock 100 that may set a privacy mode according to an embodiment of the disclosed subject matter. Door lock 100 may be part of a door 300 shown in FIG. 3A and discussed below. The door lock 100 may include a communications interface 110, a controller 120, a lock 130, and a mode selection user interface 140 which may be communicatively connected to one another via a data bus, communications, network, and/or communications path. The communications interface 100 may communicate with an electronic device, such as electronic device 200 shown in FIG. 2 and described below, and/or device 20 shown in FIGS. 5 and 7 and described below. The electronic device may communicate with the door lock 100 via the communications interface 110 so as to control a mode selection (e.g., to change the door lock 100 to a privacy mode with the controller 120). The controller 120 may control the operation of door lock 100. Alternatively, the controller 120 may control the operation of a virtual lock for other device types described above.

The controller 100 may control the operation of lock 130 (e.g., to be a locked or unlocked position) according to input received from the communications interface 110 and/or the mode selection user interface 140. The lock 130 may be, for example, a bolt lock or any other suitable locking mechanism. The mode selection user interface 140 may receive a selection of an operation mode of the door lock 100. The mode selection user interface 140 may include one or more buttons, a slider, dial, and/or other mechanism to select an operation mode. The mode selection user interface 140 may allow a user to select mode for the door lock 100. The mode may be a normal mode, a privacy mode, or the like. That is, a user may set an operation mode of the door lock 100 via the electronic device (e.g., electronic device 200 and/or device 20, or the like) and/or via the mode selection interface 140. The selection of the privacy mode for the door lock 100 may change a privacy mode of one or more devices of a security system of a building. For example, the selection of the privacy mode may change the mode of one or more devices of the security system which are present in the room associated with the door of the door lock 100.

Alternatively, or in addition, the selection of the privacy mode for a virtual door lock as described above may change a privacy mode of one or more devices of a security system of a building. For example, the selection of the privacy mode may change the mode of one or more devices of the security system which are present in the room, floor, and/or area of the building.

Figure 2:
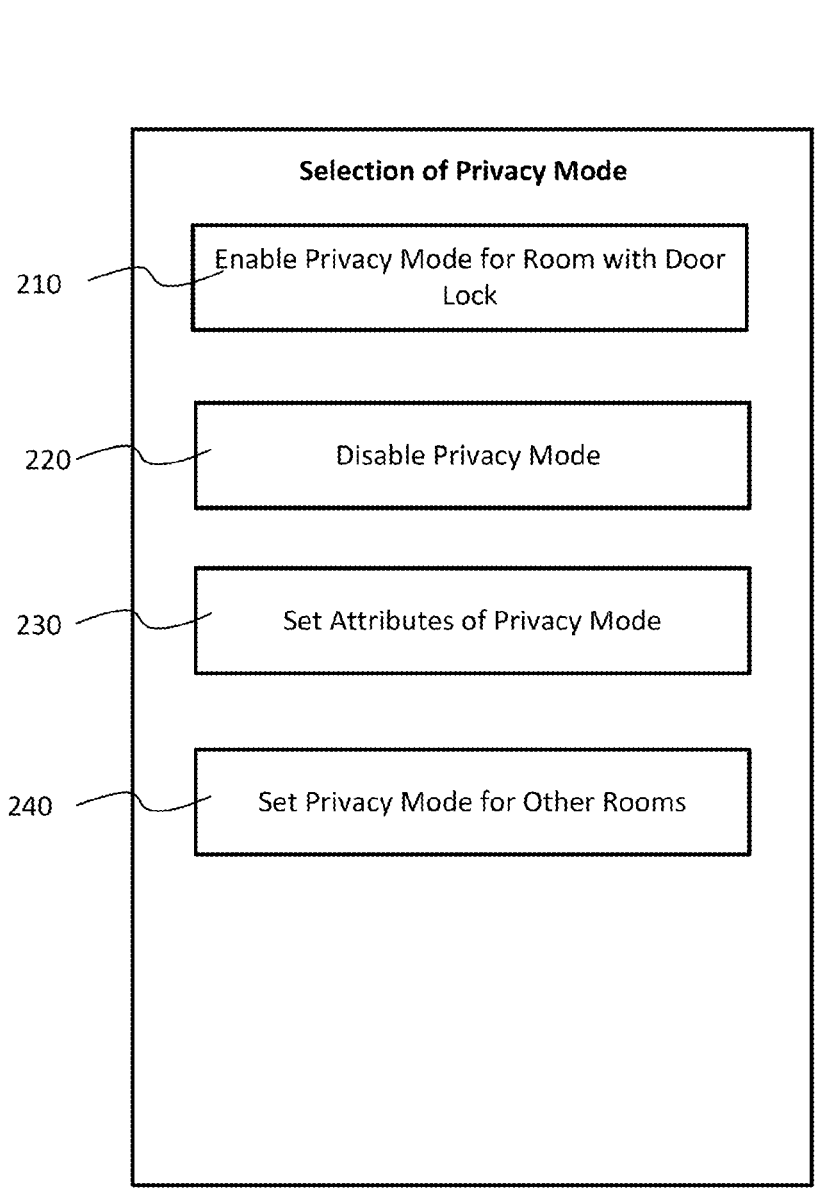
FIG. 2 shows an electronic device configured to set the privacy mode of the door lock shown in FIG. 1 according to an embodiment of the disclosed subject matter.

FIG. 2 shows an electronic device 200 configured to set the privacy mode of the door lock shown in FIG. 1 according to an embodiment of the disclosed subject matter. The electronic device may be used to set a virtual door lock as discussed above. The electronic device may be the same and/or similar to device 20 shown in FIG. 5 and FIG. 7, and as described in detail below. For example, the electronic device 200 may be a smartphone, wearable computing device, tablet computer, and the like. The electronic device 200 may have a user interface 205, such as a display, a touchscreen, a keypad, and the like. The user interface 205 may have the selectable privacy mode options. For example, the user interface 205 may include a selectable option 210 to enable the privacy mode for the room with the door lock 100. When the option 210 is selected, the door lock 100 and/or virtual door lock as discussed above may enter the privacy mode, and one or more device of the security system that are associated with the room having the door lock 100 may set their operation to a privacy mode. That is, devices (e.g., sensors, video camera, and the like) communicatively coupled to the door lock 100 and/or virtual door lock via a communications network of the security system may change their operation mode to the privacy mode (e.g., so that sensor data and/or video data is not captured or not transmitted from the device).

When option 220 of the user interface 205 is selected, the privacy mode of the door lock 100 and/or virtual door lock may be disabled. In some embodiments, this may disable the privacy mode of one or more devices associated with the door lock 100 of the security system.

When option 230 of the user interface 205 is selected, one or more attributes of the privacy mode for the door lock 100, virtual door lock, and/or any devices of the security system associated with the door lock 100. For example, the attributes to be set may include whether the devices associated with the door lock 100 and/or virtual door lock are to collect data, whether the devices of the door lock 100 and/or virtual door lock merely refrain from transmitting the collected data, whether lighting in the room associated with the door lock 100 and/or virtual door lock is to be adjusted, whether one or more window treatments associated with windows in a room associated with the door having the door lock 100 and/or virtual door lock are to be adjusted, and the like.

When the option 240 of the user interface is selected, a privacy mode for one or more rooms other than the room having the door with the door lock 100 and/or virtual door lock may be selectively set. That is, the user interface 205 may receive a selection to enable one or more devices (door locks, sensors, video camera, and the like) in other rooms of the home or building to operate in a privacy mode.

Figure 3A:
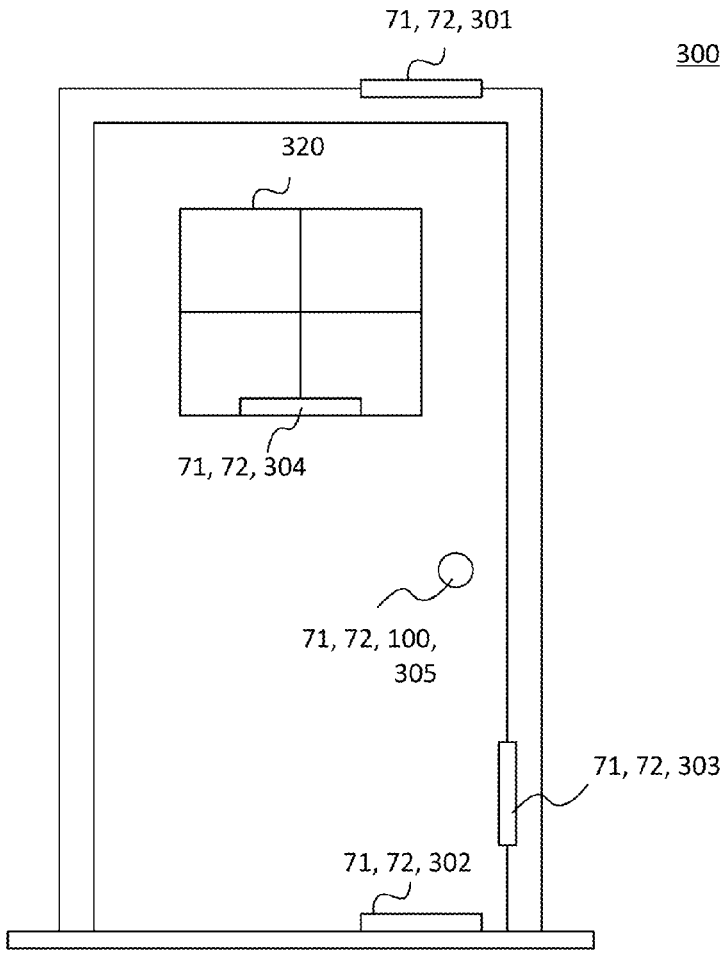
FIG. 3A shows an example door having a door lock for which a privacy mode may be set, and example sensors which may be enabled or disabled according to the privacy mode in an example embodiment of the disclosed subject matter.
Figure 3B:
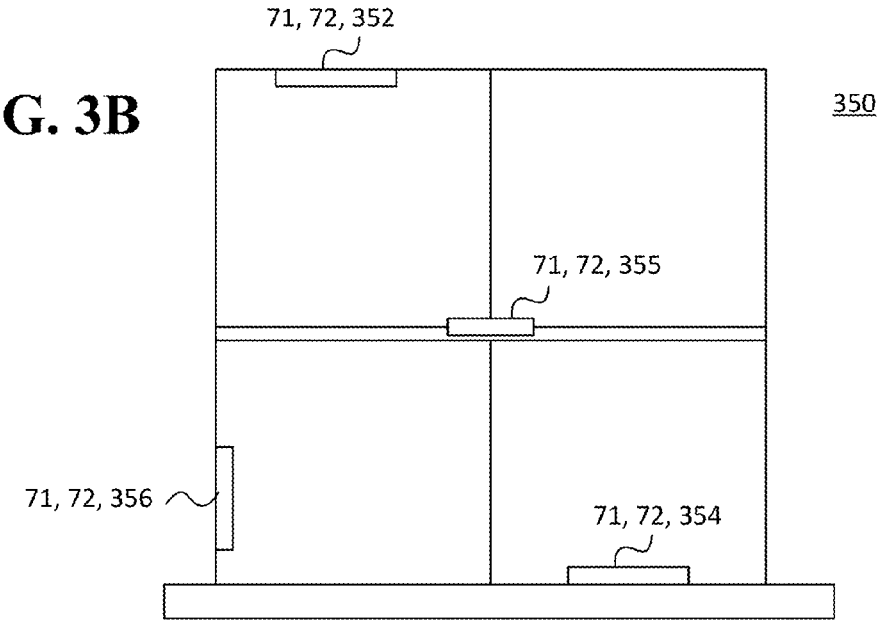
FIG. 3B shows example window sensors that may be enabled or disabled according to the setting of the privacy mode in an embodiment of the disclosed subject matter.
Figure 3C:
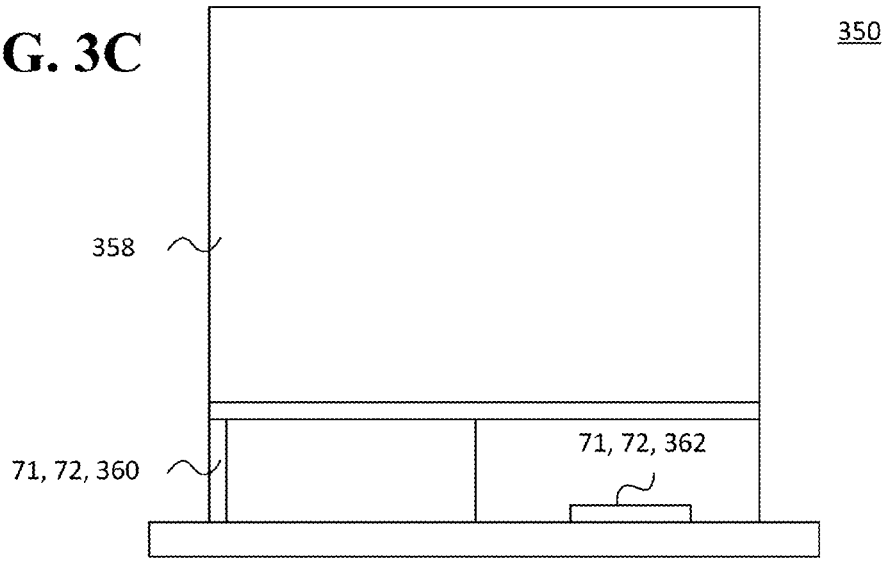
FIG. 3C shows an example window treatment that may be adjusted according to the setting of the privacy mode in an embodiment of the disclosed subject matter.

FIGS. 3A-3C show example positions of sensors as part of a home or building security system. The sensors shown in FIGS. 3A-3C may be selectively operated in a privacy mode when a door lock 100 and/or virtual door lock is operated in a privacy mode. The sensors may, for example be used to determine whether a window or door is being opened from the inside or the outside of the home or building. In some embodiments, when the security system is selectively configured to determine identity, the window sensors shown in FIGS. 3A-3C may be used in combination with a camera sensor and/or a communication interface to determine the identity of the person opening the window (e.g., from image data captured from the person and/or identifying information from a device carried by the person). Such sensors may be disposed on the inside and/or outside of the window, or within a predetermined proximity to the window, on the inside and/or outside of the home or building having the window. That is, the camera and/or communication sensors may acquire images and/or data from a variety of suitable positions near the window. To more accurately detect the opening of a window, and the side (e.g., inside or outside) that the window is being open, FIGS. 3A-3C show examples of a different types and mounting locations of sensors to determine the opening of the window from the inside or outside.

FIG. 3A shows example positions of door sensors according to an embodiment of the disclosed subject matter. The door sensors may be used to determine whether a door is being opened from the inside or the outside of the home or building. In some embodiments where a security system is selectively configured to detect an identity of a person, the door sensors shown in FIG. 3A may be used in combination with a camera sensor and/or a communication interface to determine the identity of the person opening the window (e.g., from image data captured from the person and/or identifying information from a device carried by the person). Such sensors may be disposed on the inside and/or outside of the door, or within a predetermined proximity to the door, on the inside and/or outside of the home or building having the door. That is, the camera and/or communication sensors may acquire images and/or data from a variety of suitable positions near the door. To more accurately detect the opening of a door, and the side (e.g., inside or outside) from which the door is being opened, FIG. 3A show examples of a different types and mounting locations of sensors to determine the opening of the door from the inside or outside.

As shown in FIG. 3A, sensors 71, 72 maybe mounted on and/or adjacent to door 300. For example, as shown in FIG. 3A shows that sensors 71, 72 may be mounted in position 301, 302, and/or 303. That is, the sensors 71, 72 may be mounted in a vertical position 301 in a downward-facing position. Alternatively, or in addition, the sensors 71, 72 may be mounted in a vertical position 302 in an upward-facing position. Alternatively, or in addition, the sensors 71, 72 may be mounted in a horizontal position 303.

As shown in FIG. 3A, the sensors 71, 72 may be mounted in position 305 to determine whether a door handle of the door 300 is turned and/or moved, and/or a lock of the door 300 is moved from a locked position to an unlocked position. The door 300 may include a window 320. For example, the window 320 of door 300 may not be openable. However, as shown in FIG. 3A, the sensors 71, 72 may be mounted at position 304 to determine an intrusion event, such as the breaking of the window 320. Although sensors 71, 72 as shown in FIG. 3A as being mounted in positions 301, 302, 303, 304, and/or 305, these are merely example mounting positions, and the sensors 71, 72 may be mounted in any suitable locations for sensors 71, 72 are shown in FIG. 3A, the door 300 may have one or more sensors to detect and opening event and/or an intrusion event. That is, the security system disclosed herein is not limited to the number of sensors shown in FIG. 3A.

In FIG. 3A, the sensors 71, 72 may be positioned, and/or selected according to type, and/or may be increased in number so as to detect how a home occupant opens the door from the inside. For example, the number, type, and position of the sensors may be selected so as to detect different speeds of an approach of a person to open the window. For example, some sensors may not be able to accurately detect a speed of movement above a predetermined level (e.g., a fast movement path to open a door). Accordingly, one or more sensors 71, 72 may be selected to detect different speeds of approach by a person to open a door. The sensors 71, 72 may also be able to detect a pause or stop in movement by the person in the approach to open a door. The approach by a person to open the door may include an angle and a path, where the path may be straight, curved, radial, and/or from a side.

In FIG. 3A, the types of doors on which sensors 71, 72 may be mounted may include sliding, French, double, single, pocket, storm, windowed doors, and the like. The doors may have locks, which may be in a locked or unlocked state, which may be determined by the sensors 71, 72. The sensors 71, 72 may also detect the movement of a door handle. The doors may be detected by the sensors 71, 72 as open, closed, or partially open.

Typically, unlike windows, doors may not have treatments. However, sliding doors (e.g., sliding glass doors) may have treatments, such as vertical blinds, drapes, and the like. As discussed in connection with FIGS. 3B-3C, the number, type, and/or mounting position of the sensors 71, 72 may be selected so as to increase the detection of an interior or exterior opening event, and minimize the interference of the sensors 71, 72 by the treatments. When a privacy mode is enabled, treatments associated with the door may be operated by a controller so as to cover the transparent and/or translucent portions of the door.

FIGS. 3B-3C show window 350, having one or more sensors 71, 72, which may be mounted in one or more positions relative to the window 350. As shown in FIG. 3B, the sensors 71, 72 in position 102, may be mounted so as to be in a vertical position, so as to be facing downward. The sensors 71, 72 may be mounted in position 104 so as to be in a vertical position as to be facing upward. The sensors 71, 72 in position 106 may be mounted in a horizontal position. The sensors 71, 72 may be mounted in position 105 to monitor a lock on the window 100. One of more of the sensors 71, 72 may be mounted in positions 102, 104, 105, and 106 to determine whether the opening of the window 100 is from inside the home or building, or from the outside. Although sensors 71, 72 are shown as mounted in positions 102, 104, 105, and 106 in FIG. 3B, these are merely examples of the number of sensors and mounting positions for the window 350 that may be used. For example, one sensor may be mounted (e.g., mounted in position 356), or two sensors may be mounted, such as in positions 354 and 356.

In some embodiments, to more accurately detect whether the opening of the window 100 is from the inside or the outside, sensors may be mounted in one or more positions adjacent to the window and/or within a predetermined distance from the window. For example, the sensors may be motion sensors, and may detect motion within a predetermined area from the window. This sensor data, along with the data from the sensors mounted on the window as shown in FIG. 3B (e.g., that detect motion of the window 350), may be used by the security system to determine whether the window is being opened from the inside or the outside.

As shown in FIG. 3C, the window 350 may have a window treatment 358, which may be mounted so as to cover the window 350. In particular, the window treatment 358 may be controlled so as cover the window 350 when the associated door lock 100 is operating in a privacy mode. For example, the window treatment 358 may be a shade (e.g., roller shade, Roman shades, and the like), horizontal blinds, vertical blinds, drapes, or the like. When the window treatment 358 is arranged so as to cover and/or partially cover the window 350, the window treatment 358 may interfere with the sensors 71, 72 to detect an opening event. When the sensors 71, 72 are operating in a privacy mode, they may not output notifications to the electronic device 200. In some embodiments, the window sensors 71, 72 may output a notification when a safety-related event, such as a break-in or forced entry, is detected. That is, while the window treatment may be operated to be closed so as to cover the window 350 when the sensors 71, 72 are operated in a privacy mode, the sensors 71, 72 may be placed in multiple locations on the window 350 so to minimize the interference of the window treatment 358 with the sensors when they are not being operated in the privacy mode, and so that the sensors 71, 72 may detect an unwanted entry when operating in the privacy mode, and may transmit notifications to, for example, the electronic device 200.

Accordingly, when a window 350 has a window treatment 358, the sensors 71, 72 may be mounted so as to maximize the ability of the sensors 71, 72 to detect an opening event when the window 350 has a window treatment 358 in any position. For example, as shown in FIG. 3C, if the window 350 has a window treatment 358, the number, selection, and mounting position of the sensors 71, 72 may be selected so that a window opening event may be detected. For example, as shown in FIG. 3C, two sensors (e.g., sensors 71, 72) may be mounted in positions 110 and 112. That is, one of the sensors 71, 72 may be mounted at position 110 in a horizontal orientation near the base of the window 100, and another of the sensors 71, 72 may be mounted at the base of the window 350 in a vertical position so as to face upward. Although not shown in FIG. 3C, a sensor (e.g., sensor 71, 72) be mounted at position 355 as shown in FIG. 3B, so as to detect the opening of a window lock. The sensors 71, 72 in FIG. 3C may be of the same type, or may be of different types. For example, all of the sensors 71, 72 may be motion sensors, PIR sensors, or cameras. Alternatively, one sensor of sensors 71, 72 shown in FIG. 3C may be a motion sensor, and another sensor may be a camera.

In embodiments of the disclosed subject matter, where the window 350 may be covered and/or partially covered with a window treatment 358, sensors 71, 72 that are mounted adjacent to the window 350 may be motion sensors, and one or more other sensors may be mounted within a predetermined distance of the window 350, and may be, for example, cameras and/or motion sensors. In some embodiments, when the sensors 71, 72 are not operating in the privacy mode, the controller 73 of the security system may receive images captured from the camera and/or motion data captured form motion sensors, and may acquire data from the sensors 71, 72 mounted on the window 100. That is, when the sensors 71, 72 are not operating in the privacy mode, the controller 73 may aggregate occupant motion data collected form the cameras and/or motion sensors with opening events detected by the sensors 71, 72 mounted on the window 350 in order to increase the accuracy of a window event detection from inside of the home or building. When the sensors 71, 72 are operating in the privacy mode, the controller 73 may aggregate data, and may provide a notification (e.g., to the electronic device 200) when a safety event (such as an unwanted entry) is detected. In some embodiments, the cameras may only capture image data when the security system is selectively configured to do so (e.g., when not operating in a privacy mode) and/or identify persons.

In FIGS. 3B-3C, the types of windows in which sensors 71, 72 may be mounted on may include vertical sliding, horizontal sliding, casement, horizontal pivot, vertical pivot, transom, awning windows, and the like. The windows may have locks, which may be in a locked or unlocked state, which may be determined by the sensors 71, 72. The windows may be detected by the sensors 71, 72 as open, closed, or partially open.

Figure 5:
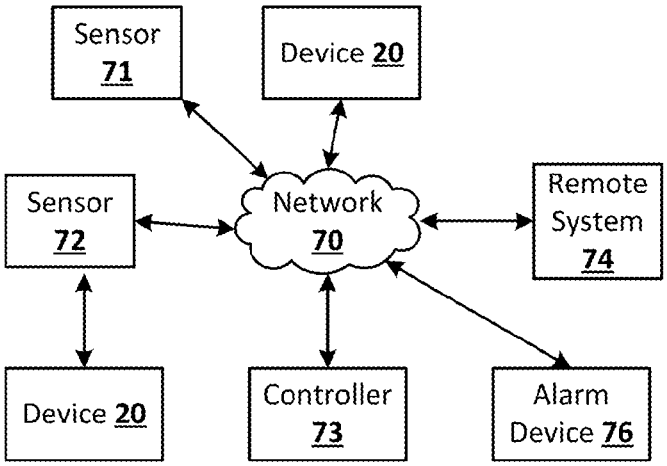
FIG. 5 shows a security system according to embodiments of the disclosed subject matter.

A controller of a smart home system, such as controller 73 of FIG. 5, may aggregate the data from the sensors disposed on and/or within a predetermined distance from the window to determine whether the window is being opened, and whether the window is being opened from the inside or outside. In some embodiments, the sensors may be turned off or may not provide data to the controller when operating in a privacy mode. In other embodiments, the sensors may provide data, when in the privacy mode, to the controller so that the controller may determine whether the window is being opened from the outside, so that the controller may provide a notification (e.g., to the electronic device 200) regarding a security event occurring from outside the home or building (e.g., the opening of the window from the outside). The controller may determine, for example, whether to output an alarm and/or notification message according to the aggregated sensor data, the mode that the security system is in (e.g., a home mode, where the occupants are at home, and are active within the home; a stay mode, where the occupants are at home, but are not actively moving about the home; an away mode, where the home is unoccupied; a vacation mode, where the occupants are away from the home for a particular duration of time, or the like), and/or identifying information of the person opening the window. A security exception may be generated by the system, so that the system does not output an alarm and/or notification message, according to whether the window is opened from the inside or outside, the mode of the sensors (e.g., privacy mode), the mode of the security system (e.g., home mode, away mode, stay mode, and the like), and/or the identity of the person opening the window. In some embodiments, an exception may be generated so as to permit a notification to be transmitted to, for example, an electronic device, when the door lock and/or associated devices are operating in the privacy mode.

In some embodiments, even when a security exception is generated (e.g., when the sensors are operating in a privacy mode), the system may be configured to output an awareness notification. For example, the notification message may provide an option to launch an application with video (e.g., an application stored on a smartphone, tablet computer, or the like) of the affected room (e.g., where the window is detected to be open) that can be presented to the user. Alternatively, or in addition, the application may provide an option to output an audio and/or visual alarm, and/or call a security monitoring company or emergency response service (e.g., police department, fire department, or the like).

A system controller may aggregate the data from the sensors disposed on and/or within a predetermined distance from the sensor to determine whether the door is being opened, and whether the door is being opened from the inside or outside. The controller may determine, for example, whether to output an alarm and/or notification message according to the aggregated sensor data, the mode of the sensors and/or door lock (e.g., a privacy mode), and/or the mode that the security system is in (e.g., home mode, stay mode, away mode, vacation mode, or the like) In some embodiments where the security system is selectively configured to identify a person, the controller may determine whether to output an alarm and/or notification message according identifying information of the person opening the door. A security exception as described above may be generated by the system, so that the system does not output an alarm and/or notification message, according to whether the door is opened from the inside or outside, the mode of the security system, and/or the identity of the person opening the door (e.g., when the system is selectively configured to do so). In some embodiments, an exception may be generated so as to permit a notification to be transmitted to, for example, an electronic device, when the door lock and/or associated devices are operating in the privacy mode.

In some embodiments, even when a security exception is generated, the system may be configured to output an awareness notification. For example, as discussed above, the notification message may provide an option to launch an application with video of the affected room that can be presented to the user. Alternatively, or in addition, the application may provide an option to output an audio and/or visual alarm, and/or call a security monitoring company or emergency response service (e.g., police department, fire department, or the like).

Figure 4:
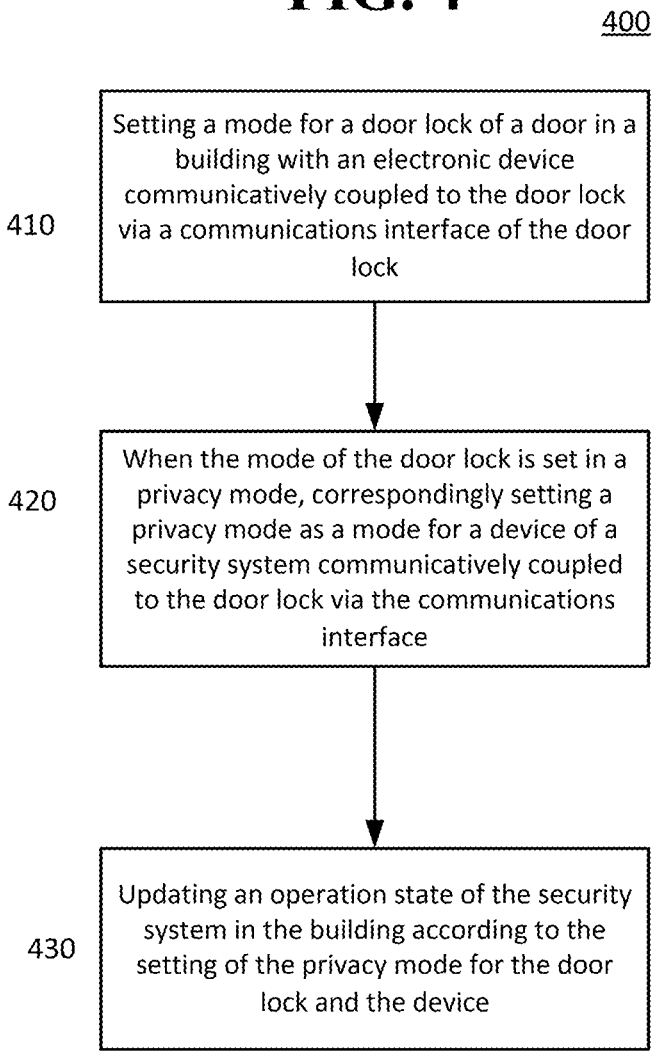
FIG. 4 shows an example method of setting a privacy mode according to an embodiment of the disclosed subject matter.

FIG. 4 shows an example method 400 of setting a privacy mode according to an embodiment of the disclosed subject matter. A mode may be set for a door lock and/or a virtual door lock of a door in a building with an electronic device communicatively coupled to the door lock via a communications interface of the door lock at operation 410. When the mode of the door lock and/or virtual door lock is set in a privacy mode, a privacy mode may be correspondingly place a security system device communicatively coupled to the door lock and/or virtual door lock into a privacy mode via the communications interface at operation 420. An operation state of the security system in the building may be updated according to the setting of the privacy mode for the door lock and/or virtual door lock and the device at operation 430.

The setting the mode of the door lock and the device to the privacy mode in the method may include at least partially disabling the receipt of notification messages to the electronic device. In some embodiments, the setting the mode of the device to the privacy mode may include at least partially disabling a device of the security system (e.g., turning off the device, having the device refrain from collecting data, having the device refrain from transmitting collected data to a security system controller, and the like). The device may be, for example, a motion sensor, a thermal sensor, a light sensor, and a video camera. The setting the mode of the device to the privacy mode may include refraining from providing data from the device to the security system when the privacy mode is enabled.

In some embodiments of the method, setting the mode of the door lock and/or virtual door lock to the privacy mode may prohibit viewing of data captured by the device of the security system via an application on the electronic device. The setting the mode of the door lock (or virtual door lock) and the device privacy mode may enable a sensor of the security system for an exterior of the building and may at least partially disable a sensor of the security system in an interior of the building.

The setting the mode of the device to the privacy mode may at least partially disable message notifications from the device to the electronic device. In some embodiments, the setting of the mode of the door lock and/or virtual door lock to the privacy mode may disable at least one of an audible output from a doorbell for the building when a button on the doorbell is selected, and/or an intercom of the building. The setting of the mode of the door lock and/or virtual door lock to the privacy mode may control the security system to activate a movement of window treatments corresponding to a window in a room having the door lock, so that the movement of the window treatments covers the window when the privacy mode is activated.

In some embodiments, the setting of the mode of the door lock and/or virtual door lock to the privacy mode may include selecting, from a user interface of the electronic device, the privacy mode of the security system for at least one of a room of the building and/or the interior of the building. The setting of the mode of the door lock and/or virtual door lock to the privacy mode may enable the security system to perform at least one of turning off lighting in a room and reducing the light output by lighting devices within a room by a predetermined level.

The setting of the mode of the door lock and/or virtual door lock to the privacy mode may include enabling the security system to close a garage door of the building. For example, as described above in connection with FIG. 2, the attributes of the privacy mode can be set, such that when the privacy mode is enabled, the controller of the security system may close the garage door.

The setting of the mode of the door lock and/or virtual to the privacy mode may at least partially disable the electronic device from receiving phone calls, e-mail, text messages, and the like. In some embodiments, the setting of the mode of the door lock to the privacy mode may configure the electronic device to receive communications from only a preset list of contacts. The preset list of contacts may be, for example, designated by a user via a user interface of the electronic device. That is, one or more contacts from a contact list stored in the electronic device may be selected such that the user may be notified when any communication from the selected contacts received by the electronic device.

In some embodiments, the setting of the mode of the door lock and/or virtual door lock to the privacy mode may be disabled and/or an exception to the privacy mode is generated by the security system when a safety event is detected by the security system. The detected safety event may be a detected smoke event, a detected fire event, a break-in event. The method may include transmitting, with the security system, a notification to the electronic device when the privacy mode is disabled, and/or when there is an exception (e.g., a communication from a person on an emergency or approved contact list, a notification for a security and/or safety event, or the like). The setting the mode of the door lock to the privacy mode may include determining whether a user or the electronic device is within a room associated with the door lock.

Embodiments of the security system of the smart-home environment disclosed herein, that may include the door lock having a privacy mode as discussed above, may use one or more sensors. In general, a "sensor" may refer to any device that can obtain information about its environment. Sensors may be described by the type of information they collect. For example, sensor types as disclosed herein may include motion, smoke, carbon monoxide, proximity, temperature, time, physical orientation, acceleration, location, entry, presence, pressure, light, sound, and the like. A sensor also may be described in terms of the particular physical device that obtains the environmental information. For example, an accelerometer may obtain acceleration information, and thus may be used as a general motion sensor and/or an acceleration sensor. A sensor also may be described in terms of the specific hardware components used to implement the sensor. For example, a temperature sensor may include a thermistor, thermocouple, resistance temperature detector, integrated circuit temperature detector, or combinations thereof. A sensor also may be described in terms of a function or functions the sensor performs within an integrated sensor network, such as a smart home environment as disclosed herein. For example, a sensor may operate as a security sensor when it is used to determine security events such as unauthorized entry. A sensor may operate with different functions at different times, such as where a motion sensor is used to control lighting in a smart home environment when an authorized user is present, and is used to alert to unauthorized or unexpected movement when no authorized user is present, or when an alarm system is in an "armed" state, or the like. In some cases, a sensor may operate as multiple sensor types sequentially or concurrently, such as where a temperature sensor is used to detect a change in temperature, as well as the presence of a person or animal. A sensor also may operate in different modes at the same or different times. For example, a sensor may be configured to operate in one mode during the day and another mode at night. As another example, a sensor may operate in different modes based upon a state of a home security system or a smart home environment, or as otherwise directed by such a system.

In general, a "sensor" as disclosed herein may include multiple sensors or sub-sensors, such as where a position sensor includes both a global positioning sensor (GPS) as well as a wireless network sensor, which provides data that can be correlated with known wireless networks to obtain location information. Multiple sensors may be arranged in a single physical housing, such as where a single device includes movement, temperature, magnetic, and/or other sensors. Such a housing also may be referred to as a sensor or a sensor device. For clarity, sensors are described with respect to the particular functions they perform and/or the particular physical hardware used, when such specification is necessary for understanding of the embodiments disclosed herein.

FIG. 5 shows an example of a smart-home environment and/or security system as disclosed herein, which may be implemented over any suitable wired and/or wireless communication networks. As discussed above, the security system of this smart home environment may at least partially disable sensors, may refrain from collecting data from sensors, and/or may refrain from having a controller of security system receive data from the sensors when the door lock and/or one or more sensors is set to a privacy mode. When the door lock and/or sensors are in the privacy mode, the security system may determine whether a door or window of a home or building is being opened from the outside, may identify the person opening the door or window, may generate a security exception to provide notifications to an electronic device (e.g., regarding a safety event and/or security event). The system may include network 70, sensors 71, 72, controller 73, remote system 74, alarm device 76, and device 20, and the like. That is, the sensors 71, 72, controller 73, remote system 74, alarm device 76, and device 20 may be communicatively coupled to one another via the network 70. As shown in FIG. 5, device 20 may be communicatively coupled to the sensor 72 and/or may be directly coupled to the network 70.

The sensors 71, 72 may communicate via the local network 70, such as a Wi-Fi or other suitable network, with each other and/or with the controller 73. The devices of the security system and smart-home environment of the disclosed subject matter (e.g., as shown in FIG. 5) may be communicatively connected via the network 70, which may be a mesh-type network such as Thread, which provides network architecture and/or protocols for devices to communicate with one another. Typical home networks may have a single device point of communications. Such networks may be prone to failure, such that devices of the network cannot communicate with one another when the single device point does not operate normally. The mesh-type network of Thread, which may be used in the security system of the disclosed subject matter, may avoid communication using a single device. That is, in the mesh-type network, such as network 70, there is no single point of communication that may fail so as to prohibit devices coupled to the network from communicating with one another.

The communication and network protocols used by the devices communicatively coupled to the network 70 may provide secure communications, minimize the amount of power used (i.e., be power efficient), and support a wide variety of devices and/or products in a home, such as appliances, access control, climate control, energy management, lighting, safety, and security. For example, the protocols supported by the network and the devices connected thereto may have an open protocol which may carry IPv6 natively.

The Thread network, such as network 70, may be easy to set up and secure to use. The network 70 may use an authentication scheme, AES (Advanced Encryption Standard) encryption, or the like to reduce and/or minimize security holes that exist in other wireless protocols. The Thread network may be scalable to connect devices (e.g., 2, 5, 10, 20, 50, 100, 150, 200, or more devices) into a single network supporting multiple hops (e.g., so as to provide communications between devices when one or more nodes of the network is not operating normally). The network 70, which may be a Thread network, may provide security at the network and application layers. One or more devices communicatively coupled to the network 70 (e.g., controller 73, remote system 74, and the like) may store product install codes to ensure only authorized devices can join the network 70. One or more operations and communications of network 70 may use cryptography, such as public-key cryptography.

The devices communicatively coupled to the network 70 of the smart-home environment and/or security system disclosed herein may low power consumption and/or reduced power consumption. That is, devices efficiently communicate to with one another and operate to provide functionality to the user, where the devices may have reduced battery size and increased battery lifetimes over conventional devices. The devices may include sleep modes to increase battery life and reduce power requirements. For example, communications between devices coupled to the network 70 may use the power-efficient IEEE 802.15.4 MAC/PHY protocol. In embodiments of the disclosed subject matter, short messaging between devices on the network 70 may conserve bandwidth and power. The routing protocol of the network 70 may reduce network overhead and latency. The communication interfaces of the devices coupled to the smart-home environment may include wireless system-on-chips to support the low-power, secure, stable, and/or scalable communications network 70.

The sensors 71, 72, which are generally described above, may detect movement of the user within a home or building. The data detected by the sensors 71, 72 may be aggregated to accurately determine an opening event of a door or window. In embodiments of the disclosed subject matter, the sensor 71, 72, when operating in a mode other than the privacy mode, may be a camera and/or motion sensor (e.g., which may include an accelerometer and/or electronic compass, or the like) to capture an image (e.g., when the system is selectively configured to identify a person) and/or movement of an occupant, which may be correlated with other data acquired from sensors 71, 72, to determine whether a window or door is being opened from the outside of the home or building. For example, when the camera of sensors 71, 72 captures one or more images of an occupant and/or senses the motion of the occupant of the home near a window, and one or more sensors 71, 72 disposed near a window may determine an opening event, the controller 73 may determine the window opening event was initiated by the occupant, and the controller 73 controls the alarm device 76 to refrain from activating an alarm.

The sensors 71, 72 may, when the system is selectively configured, acquire identifying information from a person opening the door or window. For example, the sensors 71, 72 may include a camera to capture image data of a person opening the door or window, and/or may include a communication interface or the like to capture identifying information from a device that is within the person's possession (e.g., a smartphone, wearable computing device, key FOB, RFID device, and the like).

The controller 73 shown in FIG. 5 may be communicatively coupled to the network 70 may be and/or include a processor. Alternatively, or in addition, the controller 73 may be a general- or special-purpose computer. The controller 73 may, for example, receive, aggregate, and/or analyze environmental information received from the sensors 71, 72. The sensors 71, 72 and the controller 73 may be located locally to one another, such as within a single dwelling, office space, building, room, or the like, or they may be remote from each other, such as where the controller 73 is implemented in a remote system 74 such as a cloud-based reporting and/or analysis system. Alternatively or in addition, sensors 71, 72 may communicate directly with a remote system 74. The remote system 74 may, for example, aggregate data from multiple locations, provide instruction, software updates, and/or aggregated data to a controller 73 and/or sensors 71, 72.

The controller 73 may aggregate detection data from the sensors 71, 72 and store it in a storage device coupled to the controller 73 or the network 70. The data aggregated by the controller 73 may be used to determine entrance and exit patterns (e.g., what days and times users enter and exit from the house, what doors are used, and the like) of the members of the household, and the controller 73 may arm or disarm the alarm device 76 according to the determined patterns. Alternatively, or in addition, the controller 73 may aggregated data detected by the sensors 71, 72 to determine whether a window or door is being opened, and/or the identity of the person opening the door or window. The system may transmit a notification to an electronic device, even when the sensors are in a privacy mode, that a door and/or window is being opened from the outside.

The data aggregated by the system and stored may be configured and/or transformed so that the one or more users, occupants, or the like for which data is aggregated may be anonymous. That is, in some embodiments, the user may select that the security system transform the collected data so as to make the identity of a person anonymous, and/or any detected behavior (e.g., days and times that a person leaves or enters a home, or the like) be anonymous. When one or more sensors are operated in a privacy mode, the data captured by these sensors may not be provided to the controller of the security system, and/or may not be stored by the controller of the security system. An exception may also enable the electronic device to receive communications (e.g., telephone calls, text messages, emails, and the like) and/or notifications from designated persons on an emergency contact list when the door lock and/or associated devices are operating in the privacy mode.

The controller 73 may generate a security exception according to whether the door is being opened from the inside or outside, the operation mode of the door lock and/or sensors (e.g., a privacy mode or the like), the operation mode of the security system (e.g., home, stay, away, vacation, or the like), and/or the identity of the person opening the door or window. Generally, the generated security exception may refrain from outputting an alarm and/or notification message, and thus the number of unwanted alarms and/or notifications may be minimized. In some embodiments, an exception to the privacy mode may be generated, such that the security system provides a notification (e.g., to an electronic device) when a safety event (e.g., smoke, fire, or the like) and/or security event (e.g., window and/or door is opened from the outside) is detected. As discussed above, even when a security exception is generated, the system may be configured to output an awareness notification. That is, the notification message may provide an option to launch an application with video of the affected room that can be presented to the user. Alternatively, or in addition, the application may provide an option to output an audio and/or visual alarm, and/or call a security monitoring company or emergency response service.

The security system and/or smart-home environment shown in FIG. 5 includes the remote system 74. In embodiments of the disclosed subject matter, the remote system 74 may be a law enforcement provider system, a home security provider system, a medical provider system, and/or a fire department provider system. When a security event and/or environmental event is detected by at least one of one sensors 71, 72, a message may be transmitted to the remote system 74. The content of the message may be according to the type of security event and/or environmental event detected by the sensors 71, 72. For example, if smoke is detected by one of the sensors 71, 72, the controller 73 may transmit a message to the remote system 74 associated with a fire department to provide assistance with a smoke and/or fire event (e.g., request fire department response to the smoke and/or fire event). Alternatively, the sensors 71, 72 may generate and transmit the message to the remote system 74. In another example, when one of the sensors 71, 72 detects a security event, such a window or door of a building being compromised, a message may be transmitted to the remote system 74 associated with local law enforcement to provide assistance with the security event (e.g., request a police department response to the security event).

The security system as disclosed herein and shown in FIG. 5 may include an alarm device 76, which may include, for example, a light and an audio output device. The alarm device 76 may be controlled, for example, by controller 73. The light of the alarm device 76 may be activated so as to be turned on when one or more sensors 71, 72 detect a security event and/or an environmental event. Alternatively, or in addition, the light may be turned on and off in a pattern (e.g., where the light is turned on for one second, and off for one second; where the light is turned on for two seconds, and off for one second, and the like) when one or more sensors 71, 72 detect a security event and/or an environmental event. Alternatively, or in addition, an audio output device of the alarm device 76 may include at least a speaker to output an audible alarm when a security event and/or an environmental event is detected by the one or more sensors 71, 72.

In embodiments of the disclosed subject matter, the controller 73 may control the alarm device 76 to be activated (e.g., output an audio and/or visual alarm) when a security event is detected, such as an opening and/or forced entry of a door or window of a home or building is detected. The controller 73 may refrain from outputting a control signal to the alarm device 76 and/or transmitting a notification message to a device 20 when a detected event by the sensors 71, 72 is determined to be an opening of a door or window from the inside, and/or an opening of the door or window by an identified person (e.g., a person identified according to image data and/or identifying information from a device that may be registered with the security system).

As shown in FIG. 5, the device 20 may be communicatively coupled to the network 70 so as to exchange data, information, and/or messages with the sensors 71, 72, the controller 73, and the remote system 74. For example, the device 20 may receive notifications from the security system when an opening of a door or window occurs, the location of the door or window, and the identity and/or image of the person opening the door or window.

Figure 7:
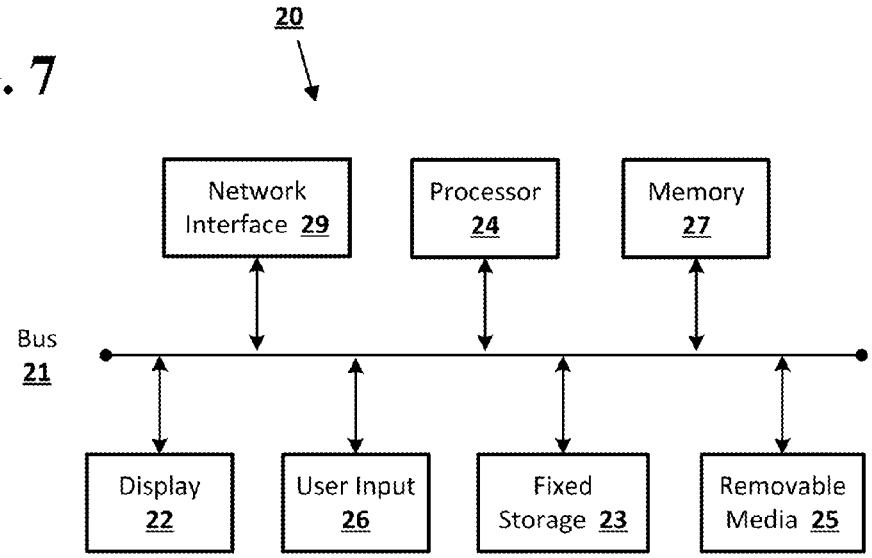
FIG. 7 shows a detailed view of the electronic device shown in FIG. 1 according to an embodiment of the disclosed subject matter.

The security system of the disclosed subject matter, as shown in FIG. 5, may include a device 20 that may be communicatively coupled to a sensor. Although FIG. 5 illustrates that device 20 is coupled to sensor 72, the device 20 may be communicatively coupled to sensor 71 and/or sensor 72. The device 20 may be a computing device as shown in FIG. 7 and described below. A user of the security system disclosed herein may control the device 20. When the device 20 is within a predetermined distance (e.g., one foot, five feet, 10 feet, 20 feet, 100 feet, or the like) from the sensor 72, the device 20 and the sensor 72 may communicate with one another via Bluetooth signals, Bluetooth Low Energy (BTLE) signals, Wi-Fi pairing signals, near field communication (NFC) signals, radio frequency (RF) signals, infra-red signals, and/or short-range communication protocol signals. In some embodiments, the device 20 may provide identifying information to the sensor 72, which may be provided to the controller 73 to determine whether the device 20 belongs to an authorized user of the security system disclosed herein. The controller 73 may monitor the location of the device 20 in order to determine whether to change an operating mode of the alarm device 76 (e.g., a home mode, a stay mode, and away mode, a vacation mode, or the like). The security system shown in FIG. 5 may detect the location of the device 20, and may correlate the detected motion of the device 20 (e.g., as being carried by an occupant of the home or building) with a detected event (e.g., an opening of a door or window, or the like) when the detected motion is within a predetermined area from the detected event. That is, the security system disclosed herein may use the detected location and/or motion of the device 20 to determine whether the detected event (e.g., the opening of the window or door) is by an occupant (e.g., according to the movement of the occupant and/or the device 20, and the detection by the sensors 71, 72 from inside the home or building). The security system may also use the detected location to determine whether to allow the privacy mode to be enabled for the door lock and/or associated sensors. For example, the person may need to be present in the room having the door lock before the privacy mode may be enabled. The security system may be selectively configured to acquire identifying information from the device 20, so that a person opening the door or window can be identified, and a security exception may be generated, so as to reduce the number of unintended alarms and/or notifications.

In some selective configurations of the security system, when the sensor 72 and/or the controller 73 determine that the device 20 is associated with an authorized user according to the transmitted identification information, the sensor 72 and/or the controller 73 provide an operational status message to the user via a speaker (i.e., audio output 77), a display (e.g., where the display is coupled to the controller 73 and/or remote system 74), and/or the device 20. The operational status message displayed can include, for example, a message that a security event (e.g., a window or door has been opened) and/or environmental event has occurred. In some embodiments, the message may be provided when the door lock and/or associated devices are operating in a privacy mode. When the sensors 71, 72 have not detected a security and/or environmental event, a message may be displayed that no security and/or environmental event has occurred. In some embodiments, this message may not be transmitted and/or displayed on the electronic device when the door lock and/or associated devices are operating in the privacy mode.

In embodiments of the subject matter disclosed herein, the device 20 may display a source of the security event and/or environmental event, a type of the security event and/or environmental event, a time of the security event and/or environmental event, and a location of the security event and/or environmental event. In some embodiments, the system may refrain from transmitting a status message when a window or door is opened according to the operating mode of the door lock (or virtual door lock) and/or associated devices (e.g., a privacy mode), the operating mode of the security system (e.g., a stay mode, an away mode, etc.), whether the door or window is opened from the inside or outside, and the identity of the person opening the door or window. The system may generate a security exception to refrain from transmitting the status message.

The sensor network shown in FIG. 5 may be an example of a smart-home environment. The depicted smart-home environment may include a structure, a house, office building, garage, mobile home, or the like. The devices of the smart home environment, such as the sensors 71, 72, the controller 73, and the network 70 may be integrated into a smart-home environment that does not include an entire structure, such as an apartment, condominium, or office space.

The smart home environment can control and/or be coupled to devices outside of the structure. For example, one or more of the sensors 71, 72 may be located outside the structure, for example, at one or more distances from the structure (e.g., sensors 71, 72 may be disposed outside the structure, at points along a land perimeter on which the structure is located, and the like). One or more of the devices in the smart home environment need not physically be within the structure. For example, the controller 73 which may receive input from the sensors 71, 72 may be located outside of the structure.

The structure of the smart-home environment may include a plurality of rooms, separated at least partly from each other via walls. The walls can include interior walls or exterior walls. Each room can further include a floor and a ceiling. Devices of the smart-home environment, such as the sensors 71, 72, may be mounted on, integrated with and/or supported by a wall, floor, or ceiling of the structure.

The smart-home environment including the sensor network shown in FIG. 5 may include a plurality of devices, including intelligent, multi-sensing, network-connected devices that can integrate seamlessly with each other and/or with a central server or a cloud-computing system (e.g., controller 73 and/or remote system 74) to provide home-security and smart-home features. The smart-home environment may include one or more intelligent, multi-sensing, network-connected thermostats (e.g., "smart thermostats"), one or more intelligent, network-connected, multi-sensing hazard detection units (e.g., "smart hazard detectors"), and one or more intelligent, multi-sensing, network-connected entryway interface devices (e.g., "smart doorbells"). The smart hazard detectors, smart thermostats, and smart doorbells may be the sensors 71, 72 shown in FIG. 5.

For example, a smart thermostat may detect ambient climate characteristics (e.g., temperature and/or humidity)

and may control an HVAC (heating, ventilating, and air conditioning) system accordingly of the structure. For example, the ambient client characteristics may be detected by sensors 71, 72 shown in FIG. 5, and the controller 73 may control the HVAC system (not shown) of the structure.

As another example, a smart hazard detector may detect the presence of a hazardous substance or a substance indicative of a hazardous substance (e.g., smoke, fire, or carbon monoxide). For example, smoke, fire, and/or carbon monoxide may be detected by sensors 71, 72 shown in FIG. 5 and the controller 73 may control an alarm system to provide a visual and/or audible alarm to the user of the smart-home environment.

As another example, a smart doorbell may control doorbell functionality (e.g., turn off the doorbell when the door lock is operating in a privacy mode), detect a person's approach to or departure from a location (e.g., an outer door to the structure), and announce a person's approach or departure from the structure via audible and/or visual message that is output by a speaker and/or a display coupled to, for example, the controller 73.

In some embodiments, the smart-home environment of the sensor network shown in FIG. 5 may include one or more intelligent, multi-sensing, network-connected wall switches (e.g., "smart wall switches"), one or more intelligent, multi-sensing, network-connected wall plug interfaces (e.g., "smart wall plugs"). The smart wall switches and/or smart wall plugs may be or include one or more of the sensors 71, 72 shown in FIG. 5. A smart wall switch may detect ambient lighting conditions, and control a power and/or dim state of one or more lights. For example, a sensor such as sensors 71, 72, may detect ambient lighting conditions, and a device such as the controller 73 may control the power to one or more lights (not shown) in the smart-home environment. Smart wall switches may also control a power state or speed of a fan, such as a ceiling fan. For example, sensors 72, 72 may detect the power and/or speed of a fan, and the controller 73 may adjusting the power and/or speed of the fan, accordingly. Smart wall plugs may control supply of power to one or more wall plugs (e.g., such that power is not supplied to the plug if nobody is detected to be within the smart-home environment). For example, one of the smart wall plugs may controls supply of power to a lamp (not shown).

In embodiments of the disclosed subject matter, a smart-home environment may include one or more intelligent, multi-sensing, network-connected entry detectors (e.g., "smart entry detectors"). Such detectors may be or include one or more of the sensors 71, 72 shown in FIG. 5. The illustrated smart entry detectors (e.g., sensors 71, 72) may be disposed at one or more windows, doors, and other entry points of the smart-home environment for detecting when a window, door, or other entry point is opened, broken, breached, and/or compromised. The smart entry detectors may generate a corresponding signal to be provided to the controller 73 and/or the remote system 74 when a window or door is opened, closed, breached, and/or compromised. In some embodiments of the disclosed subject matter, the alarm system, which may be included with controller 73 and/or coupled to the network 70 may not arm unless all smart entry detectors (e.g., sensors 71, 72) indicate that all doors, windows, entryways, and the like are closed and/or that all smart entry detectors are armed. As disclosed herein, the smart entry detectors may determine whether a window or door is open from the inside or outside, and/or may determine the identity of the person opening the door or window. In some embodiments, the smart entry detectors may continue to operate when the door lock and/or associated devices are operating in a privacy mode.

The smart-home environment of the sensor network shown in FIG. 5 can include one or more intelligent, multi-sensing, network-connected doorknobs (e.g., "smart doorknob"). For example, the sensors 71, 72 may be coupled to a doorknob of a door (e.g., at position 305 of door 300 shown in FIG. 3, and/or located on external doors of the structure of the smart-home environment). In some embodiments, the smart doorknob may be coupled to the door lock 100 and/or virtual door lock as described above. However, it should be appreciated that smart doorknobs can be provided on external and/or internal doors of the smart-home environment. As disclosed herein, the smart doorknob may determine whether a door is open from the inside or outside. For example, the smart doorknob may sense which side of the door a person is opening the door from (e.g., according to which side of the doorknob a person is grasping to turn the doorknob, or the like).

The smart thermostats, the smart hazard detectors, the smart doorbells, the smart wall switches, the smart wall plugs, the smart entry detectors, the smart doorknobs, the keypads, and other devices of a smart-home environment (e.g., as illustrated as sensors 71, 72 of FIG. 5 can be communicatively coupled to each other via the network 70, and to the controller 73 and/or remote system 74 to provide security, safety, and/or comfort for the smart home environment).

A user can interact with one or more of the network-connected smart devices (e.g., via the network 70). For example, a user can communicate with one or more of the network-connected smart devices using the electronic device 200 of FIG. 2, a computer (e.g., a desktop computer, laptop computer, tablet, or the like) or other portable electronic device (e.g., a smartphone, smart watch, wearable computing device, a tablet, radio frequency identification (RFID) tags, a key FOB, and the like). A webpage or application can be configured to receive communications from the user and control the one or more of the network-connected smart devices based on the communications and/or to present information about the device's operation to the user. For example, the user can view can arm or disarm the security system of the home.

One or more users can control one or more of the network-connected smart devices in the smart-home environment using a network-connected computer or portable electronic device (e.g., device 200 shown in FIG. 2 and/or device 20, as shown in FIGS. 5 and 7, and discussed in detail below). In some examples, some or all of the users (e.g., individuals who live in the home) can register their mobile device and/or key FOBs with the smart-home environment (e.g., with the controller 73). When the security system is selectively configured, image data of the users or other authorized persons may be stored by the security system so that captured image data from the sensor may be compared with the stored image data of the registered users. Such registration can be made at a central server (e.g., the controller 73 and/or the remote system 74) to authenticate the user and/or the electronic device as being associated with the smart-home environment, and to provide permission to the user to use the electronic device to control the network-connected smart devices and the security system of the smart-home environment. A user can use their registered electronic device to remotely control the network-connected smart devices and security system of the smart-home environment, such as when the occupant is at work or on vacation. The user may also use their registered electronic device to control the network-connected smart devices when the user is located inside the smart-home environment.

Alternatively, or in addition to registering electronic devices, the smart-home environment may make inferences about which individuals live in the home and are therefore users and which electronic devices are associated with those individuals. As discussed above, the security system may be configured so that individuals remain anonymous, and that personal data is only transmitted to a remote system by selectively opting to do so. When the system is selectively configured, captured image data may be used and/or stored by the smart-home environment to learn which individuals are authorized to be in the home or building, and/or to open door or window (e.g., so as to create a security exception, based on their identity). As such, the smart-home environment may "learn" who is a user (e.g., an authorized user), and/or may permit the electronic devices associated with those individuals to control the network-connected smart devices of the smart-home environment (e.g., devices communicatively coupled to the network 70), in some embodiments including sensors used by or within the smart-home environment.

In the smart-home environment, various types of notices and other information may be provided to users via messages sent to one or more user electronic devices (e.g., electronic device 200, device 20, and the like). For example, the messages can be sent via email, short message service (SMS), multimedia messaging service (MMS), unstructured supplementary service data (USSD), as well as any other type of messaging services and/or communication protocols. As described above, the electronic device (e.g., electronic device 200 and/or device 20) may refrain from providing the notices and/or information when the door lock and/or associated devices are operating in the privacy mode.

A smart-home environment may include communication with devices outside of the smart-home environment but within a proximate geographical range of the home. For example, the smart-home environment may include an outdoor lighting system (not shown) that communicates information through the communication network 70 or directly to a central server or cloud-computing system (e.g., controller 73 and/or remote system 74) regarding detected movement and/or presence of people, animals, and any other objects and receives back commands for controlling the lighting accordingly.

Figure 6:
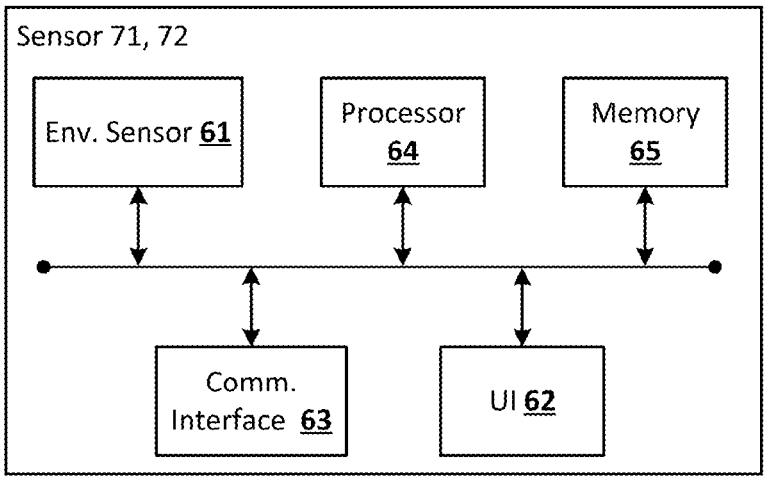
FIG. 6 shows an example sensor according to an embodiment of the disclosed subject matter.

The sensor 71, 72, as shown in FIG. 5, may include hardware in addition to the specific physical sensor that obtains information about the environment. FIG. 6 shows an example sensor as disclosed herein. The sensors 71, 72 may include an environmental sensor 61, such as a temperature sensor, smoke sensor, carbon monoxide sensor, motion sensor, accelerometer, proximity sensor, camera sensor, passive infrared (PIR) sensor, magnetic field sensor, radio frequency (RF) sensor, light sensor, humidity sensor, pressure sensor, microphone, or any other suitable environmental sensor, that obtains a corresponding type of information about the environment in which the sensors 71, 72 is located. A processor 64 may receive and analyze data obtained by the sensor 61, control operation of other components of the sensor 71, 72, and process communication between the sensor and other devices. The processor 64 may execute instructions stored on a computer-readable memory 65. The memory 65 or another memory in the sensor 71, 72 may also store environmental data obtained by the sensor 61. A communication interface 63, such as a Wi-Fi or other wireless interface, Ethernet or other local network interface, or the like may allow for communication by the sensors 71, 72 with other devices. A user interface (UI) 62 may provide information and/or receive input from a user of the sensor. The UI 62 may include, for example, a speaker to output an audible alarm when an event is detected by the sensors 71, 72. Alternatively, or in addition, the UI 62 may include a light to be activated when an event is detected by the sensors 71, 72. The user interface may be relatively minimal, such as a liquid crystal display (LCD), light-emitting diode (LED) display, or limited-output display, or it may be a full-featured interface such as a touchscreen. Components within the sensors 71, 72 may transmit and receive information to and from one another via an internal bus or other mechanism as will be readily understood by one of skill in the art. One or more components may be implemented in a single physical arrangement, such as where multiple components are implemented on a single integrated circuit. Sensors as disclosed herein may include other components, and/or may not include all of the illustrative components shown.

Embodiments of the presently disclosed subject matter may be implemented in and used with a variety of computing devices. FIG. 7 as an example computing device 20 suitable for implementing embodiments of the presently disclosed subject matter. In some embodiments, the electronic device 200 shown in FIG. 2 may be similar and/or the same as device 20 shown in FIGS. 5 and 7, and as described herein. The computing device may be the device 20 illustrated in FIG. 5 and discussed above. The device 20 may be used to implement a controller, a device including sensors as disclosed herein, or the like. Alternatively or in addition, the device 20 may be, for example, a desktop or laptop computer, or a mobile computing device such as a smart phone, tablet, key FOB, or the like. The device 20 may include a bus 21 which interconnects major components of the computer 20, such as a central processor 24, a memory 27 such as Random Access Memory (RAM), Read Only Memory (ROM), flash RAM, or the like, a user display 22 such as a display screen and/or lights (e.g., green, yellow, and red lights, such as light emitting diodes (LEDs) to provide the operational status of the security system to the user, as discussed above), a user input interface 26, which may include one or more controllers and associated user input devices such as a keyboard, mouse, touch screen, and the like, a fixed storage 23 such as a hard drive, flash storage, and the like, a removable media component 25 operative to control and receive an optical disk, flash drive, and the like, and a network interface 29 operable to communicate with one or more remote devices via a suitable network connection.

The bus 21 allows data communication between the central processor 24 and one or more memory components 25, 27, which may include RAM, ROM, and other memory, as previously noted. Applications resident with the computer 20 are generally stored on and accessed via a computer readable storage medium.

The fixed storage 23 may be integral with the computer 20 or may be separate and accessed through other interfaces. The network interface 29 may provide a direct connection to a remote server via a wired or wireless connection. The network interface 29 may provide a communications link with the network 70, sensors 71, 72, controller 73, and/or the remote system 74 as illustrated in FIG. 5. The network interface 29 may provide such connection using any suitable technique and protocol as will be readily understood by one of skill in the art, including digital cellular telephone, radio frequency (RF), Wi-Fi, Bluetooth®, Bluetooth Low Energy (BTLE), near-field communications (NFC), and the like. For example, the network interface 29 may allow the device to communicate with other computers via one or more local, wide-area, or other communication networks, as described in further detail herein.

Figure 8:
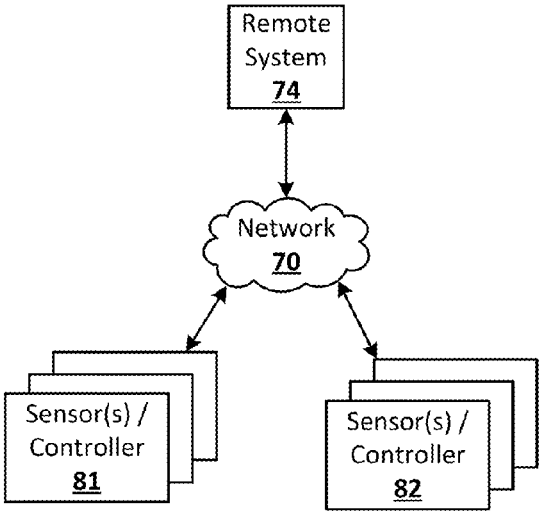
FIG. 8 shows a remote system to aggregate data from multiple locations having security systems according to an embodiment of the disclosed subject matter.

As shown in FIG. 8, a remote system 74 may aggregate data from multiple locations, such as multiple buildings, multi-resident buildings, individual residences within a neighborhood, multiple neighborhoods, and the like. In embodiments of the disclosed subject matter, unless a user of the security system actively configure the system so as to transmit identification information and/or other personal data, such data may not be transmitted and/or aggregated so as to be provided to the remote system 74.

In general, multiple sensor/controller systems 81, 82 as previously described with respect to FIG. 5 may provide information to the remote system 74. The systems 81, 82 may provide data directly from one or more sensors as previously described, or the data may be aggregated and/or analyzed by local controllers such as the controller 73, which then communicates with the remote system 74. The remote system may aggregate and analyze the data from multiple locations, and may provide aggregate results to each location. For example, the remote system 74 may examine larger regions for common sensor data or trends in sensor data, and provide information on the identified commonality or environmental data trends to each local system 81, 82.

In situations in which the systems discussed here collect personal information about users, or may make use of personal information, the users may be provided with an opportunity to control whether programs or features collect user information (e.g., information about a user's social network, social actions or activities, profession, a user's preferences, or a user's current location), or to control whether and/or how to receive content from the content server that may be more relevant to the user. In addition, certain data may be treated in one or more ways before it is stored or used, so that personally identifiable information is removed. For example, specific information about a user's image and/or a user's residence may be treated so that no personally identifiable information can be determined for the user, or a user's geographic location may be generalized where location information is obtained (such as to a city, ZIP code, or state level), so that a particular location of a user cannot be determined. As another example, systems disclosed herein may allow a user to restrict the information collected by those systems to applications specific to the user, such as by disabling or limiting the extent to which such information is aggregated or used in analysis with other information from other users. Thus, the user may have control over how information is collected about the user and used by a system as disclosed herein.

Various embodiments of the presently disclosed subject matter may include or be embodied in the form of computer-implemented processes and apparatuses for practicing those processes. Embodiments also may be embodied in the form of a computer program product having computer program code containing instructions embodied in non-transitory and/or tangible media, such as hard drives, USB (universal serial bus) drives, or any other machine readable storage medium, such that when the computer program code is loaded into and executed by a computer, the computer becomes an apparatus for practicing embodiments of the disclosed subject matter. When implemented on a general-purpose microprocessor, the computer program code may configure the microprocessor to become a special-purpose device, such as by creation of specific logic circuits as specified by the instructions.

Embodiments may be implemented using hardware that may include a processor, such as a general purpose microprocessor and/or an Application Specific Integrated Circuit (ASIC) that embodies all or part of the techniques according to embodiments of the disclosed subject matter in hardware and/or firmware. The processor may be coupled to memory, such as RAM, ROM, flash memory, a hard disk or any other device capable of storing electronic information. The memory may store instructions adapted to be executed by the processor to perform the techniques according to embodiments of the disclosed subject matter.

The foregoing description, for purpose of explanation, has been described with reference to specific embodiments. However, the illustrative discussions above are not intended to be exhaustive or to limit embodiments of the disclosed subject matter to the precise forms disclosed. Many modifications and variations are possible in view of the above teachings. The embodiments were chosen and described in order to explain the principles of embodiments of the disclosed subject matter and their practical applications, to thereby enable others skilled in the art to utilize those embodiments as well as various embodiments with various modifications as may be suited to the particular use contemplated.

The invention claimed is:

1. A method comprising:

setting a privacy mode for a first device that is included in a security system of a building; and controlling the operation of a second device of the security system, which is located in a portion of the building and is communicatively coupled to the first device, so that the second device correspondingly operates in the privacy mode so as to control the privacy of a room, a floor, or a portion of the building.

2. The method of claim 1, wherein the setting of the privacy mode for the first device comprises:

setting the privacy mode for at least one from the group consisting of: a door lock, a virtual door lock, a room status, a floor status in the building, an area status in the building, a doorbell, and one or more sensors of a room.

3. The method of claim 1, wherein the setting of the privacy mode of the first device comprises at least partially disabling the second device of the security system, wherein the second device is selected from the group consisting of: a motion sensor, a thermal sensor, a light sensor, and a video camera.

4. The method of claim 1, wherein the setting of the privacy mode of the first device comprises refraining from providing data from the second device to the security system when the privacy mode is enabled.

5. The method of claim 1, wherein the setting of the privacy mode of the first device prohibits viewing of data captured by the second device of the security system via an application on an electronic device that is communicatively coupled to the security system.

6. The method of claim 1, wherein the setting of the privacy mode of the first device and the second device to the privacy mode enables a sensor of the security system for an exterior of the building, and at least partially disables a sensor of the security system in an interior of the building.

7. The method of claim 1, wherein the setting of the privacy mode of the first device disables message notifications from the first device to an electronic device communicatively coupled to the security system.

8. The method of claim 1, wherein the setting of the privacy mode of the first device at least partially disables at least one of the group consisting of: an audible output from a doorbell for the building when a button on the doorbell is selected, and an intercom of the building.

9. The method of claim 1, wherein the setting of the privacy mode of the first device controls the security system to activate a movement of window treatments corresponding to a window in the room having the first device, so that the movement of the window treatments covers the window when the privacy mode is activated.

10. The method of claim 1, wherein the setting of the privacy mode of the first device comprises:

selecting, from a user interface of an electronic device communicatively coupled to the security system, the privacy mode of the security system for at least one of the group consisting of: a room of the building, and the interior of the building.

11. The method of claim 1, wherein the setting of the privacy mode of the first device enables the security system to perform at least one from the group consisting of: turning off lighting in the room and reducing the light output by lighting devices within the room by a predetermined level.

12. The method of claim 1, wherein the setting of the privacy mode of the first device enables the security system to close a garage door of the building.

13. The method of claim 1, wherein the setting of the privacy mode of the first device at least partially disables an electronic device communicatively coupled to the security system from receiving at least one of the group consisting of: phone calls, e-mail, and text messages.

14. The method of claim 13, wherein the setting of the privacy mode of the first device configures the electronic device to receive communications from only a preset list of contacts.

15. The method of claim 1, wherein the setting of the privacy mode of the first device is disabled when a safety event is detected by the security system.

16. The method of claim 15, wherein the detected safety event is from a group consisting of: a smoke event, a fire event, and a break-in event.

17. The method of claim 15, further comprising:

transmitting, with the security system, a notification to an electronic device communicatively coupled to the security system when the privacy mode is disabled.

18. The method of claim 1, wherein setting the privacy mode of the first device comprises at least one from the group consisting of: determining whether a user is within the room associated with the first device and determining whether an electronic device that is communicatively coupled to the security system is within the room associated with the door lock.

19. A system comprising:

a first device with a settable privacy mode, wherein the first device is included in a security system of a building; and an electronic device communicatively coupled to the first device to set the privacy mode of the first device and to correspondingly set a privacy mode for a second device of the security system to control the privacy of a room, a floor, or a portion of the building.

20. The system of claim 19, wherein the first device comprises at least one from the group consisting of: a door lock, a virtual door lock, a room status identification device, a floor status identifier for the building, an area status identifier for building, a doorbell, and one or more sensors of the room.

21. The system of claim 19, wherein when the privacy mode of the first device is set, the second device is at least partially disabled from the security system, wherein the device is selected from the group consisting of: a motion sensor, a thermal sensor, a light sensor, and a video camera.

22. The system of claim 19, wherein the second device refrains from providing data to the security system when the privacy mode of the second device is enabled.

23. The system of claim 19, wherein the privacy mode prohibits viewing of data captured by the second device of the security system via an application on the electronic device.

24. The system of claim 19, wherein the electronic device controls the enabling of a sensor of the security system for an exterior of the building and disables a sensor of the security system in an interior of the building when the electronic device sets the mode of the first device and the second device to the privacy mode.

25. The system of claim 19, wherein when the privacy mode of the first device is set by the electronic device, it disables at least one of the group consisting of: an audible output from a doorbell for the building when a button on the doorbell is selected, and an intercom of the building.

26. The system of claim 19, wherein when the privacy mode of the first device is set by the electronic device, the security system is controlled so as to activate a movement of window treatments corresponding to a window in a room having the first device, so that the movement of the window treatments covers the window.

27. The system of claim 19, wherein when the electronic device sets the privacy mode of the first device, it enables the security system to perform at least one from the group consisting of: turning off lighting in the room and reducing the light output by lighting devices within the room by a predetermined level.

28. The system of claim 19, wherein when the electronic device sets the privacy mode, it enables the security system to close a garage door of the building.

29. The system of claim 19, wherein when the electronic device sets the privacy mode of the first device, it disables the electronic device from receiving at least one of the group consisting of: phone calls, e-mail, and text messages.

30. The system of claim 19, wherein when the electronic device sets the privacy mode of the first device, the electronic device is configured so as to receive communications from only a preset list of contacts.

31. The system of claim 19, wherein the privacy mode is disabled when a safety event is detected by the security system.

32. The system of claim 31, wherein the detected safety event is from a group consisting of: a detected smoke event, a detected fire event, and a break-in event.

33. The system of claim 31, wherein the security system transmits a notification to the electronic device when the privacy mode is disabled.

34. The system of claim 19, wherein the electronic device determines it is within a room associated with the first device when the first device is set to the privacy mode.

35. A method comprising:

setting a mode for a door lock of a door in a building via an interface of the door lock, wherein the door lock is communicatively coupled to a security system;

when the mode of the door lock is set in a privacy mode, correspondingly operating at least one device of the security system in an operating mode that is a privacy mode; and when the mode of the door lock is changed from the privacy mode, updating the operating mode of the at least one device of the security system.

36. A system comprising:

a door lock of a door in a building with a settable mode via an interface of the door lock, wherein the door lock is communicatively coupled to a security system; and at least one device that is communicatively coupled to the security system that correspondingly operates in an operating mode that is a privacy mode when the mode of the door lock is set in a privacy mode, and updates the operating mode of the at least one device of the security system when the mode of the door lock is changed from the privacy mode.

* * * * *